United States Patent [19]

Schafer

[11] 4,161,704

[45] Jul. 17, 1979

[54] COAXIAL CABLE AND METHOD OF MAKING THE SAME

[75] Inventor: Robert H. Schafer, Perkasie, Pa.

[73] Assignee: Uniform Tubes, Inc., Collegeville, Pa.

[21] Appl. No.: 760,878

[22] Filed: Jan. 21, 1977

[51] Int. Cl.[2] ..... H01P 3/06; H01P 1/20; H01P 11/00; H01P 1/30

[52] U.S. Cl. ..... 333/33; 29/600; 333/206; 333/243; 333/245

[58] Field of Search ..... 333/73 C, 70 R, 96, 333/97 R, 73 R, 33-35, 84 R, 98 R; 29/600, 601; 174/28, 70 R, 70 S, 75 C, 50.55, 88 C

[56] References Cited

U.S. PATENT DOCUMENTS

| | | | |
|---|---|---|---|
| 2,437,482 | 3/1948 | Salisbury | 333/96 |
| 2,438,913 | 4/1948 | Hansen | 333/73 C |
| 2,603,707 | 7/1952 | Jaynes | 333/96 |
| 2,983,884 | 5/1961 | Rueger | 333/33 |
| 2,998,472 | 8/1961 | Bondon | 333/96 |
| 3,452,429 | 7/1969 | Liebscher | 333/96 |
| 3,760,306 | 9/1973 | Spinner et al. | 333/33 X |

*Primary Examiner*—Alfred E. Smith
*Assistant Examiner*—Marvin Nussbaum
*Attorney, Agent, or Firm*—Seidel, Gonda, Goldhammer & Panitch

[57] ABSTRACT

Circuit components such as frequency filters, impedance transformers, and time delay elements are fabricated into an assembly which is electrically and mechanically coupled to the center conductor. A seamless dielectric material is telescoped over the assembly and then the assembly is telescoped into a seamless outer jacket of conductive material. Then the ID of the outer jacket is reduced into contact with the dielectric material surrounding said assembly and center conductor by drawing said jacket through a die.

14 Claims, 10 Drawing Figures

FIG. 1
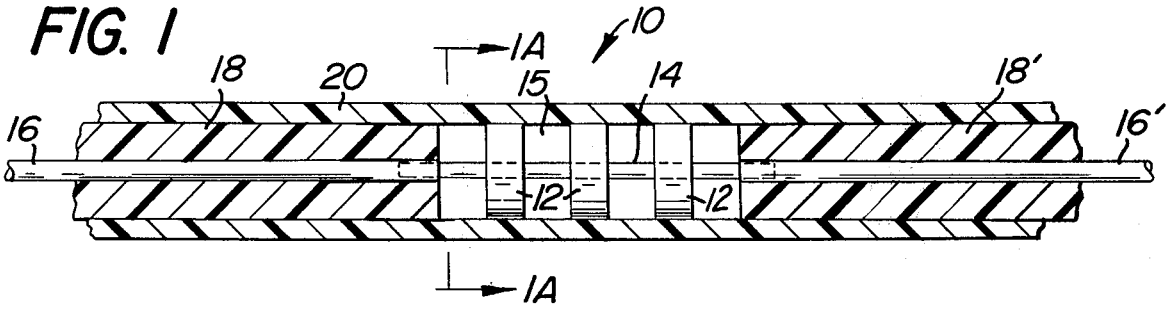
FIG. 1A
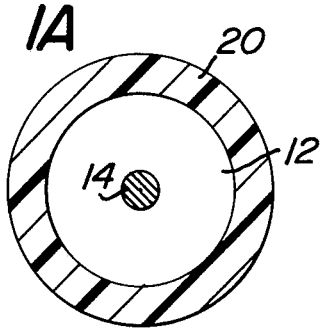
FIG. 2A
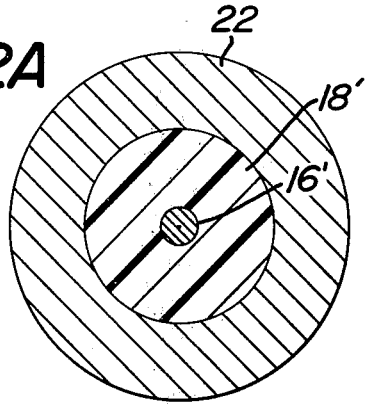
FIG. 2
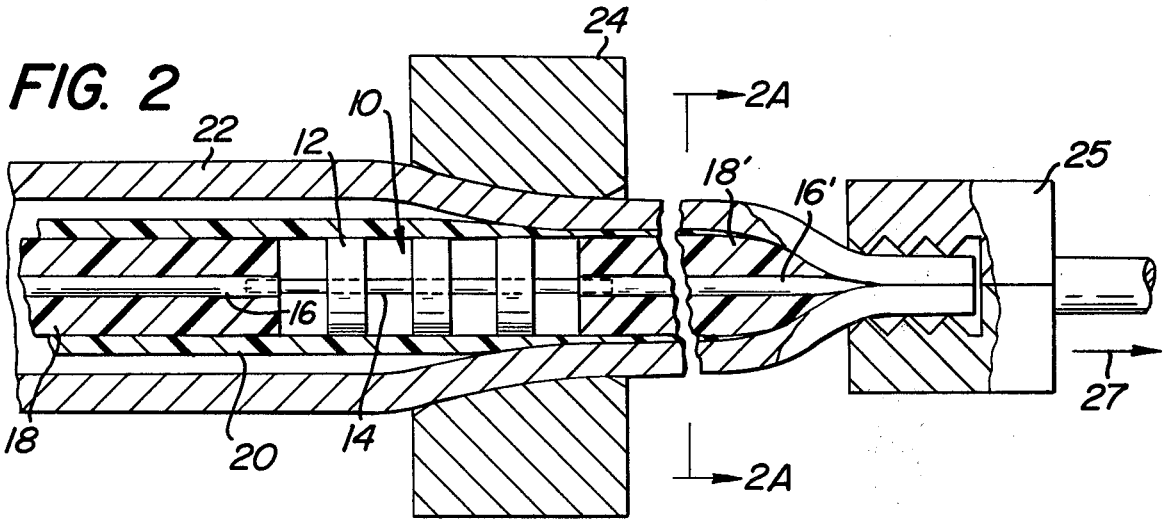
FIG. 3
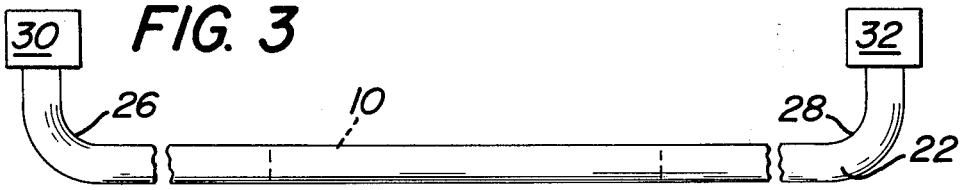
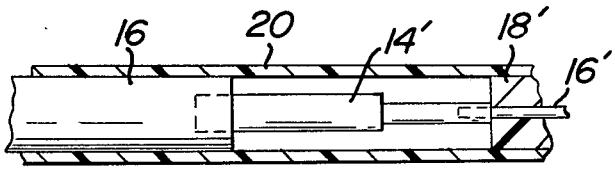
FIG. 4
34
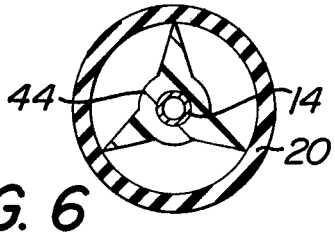
FIG. 6

FIG. 5
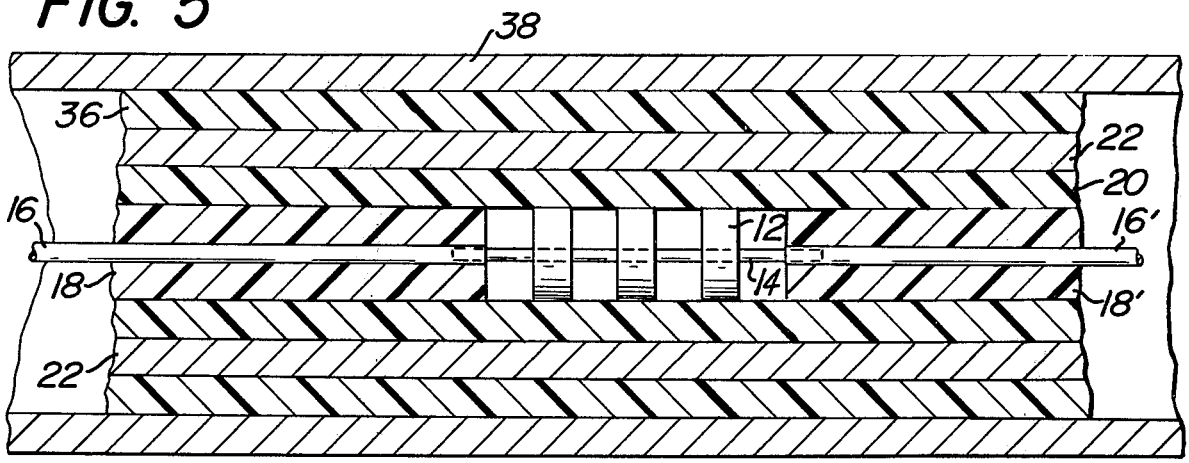
FIG. 7
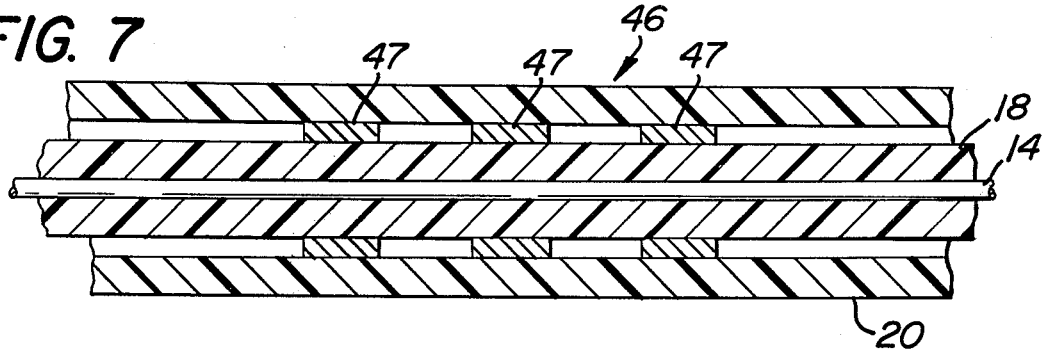
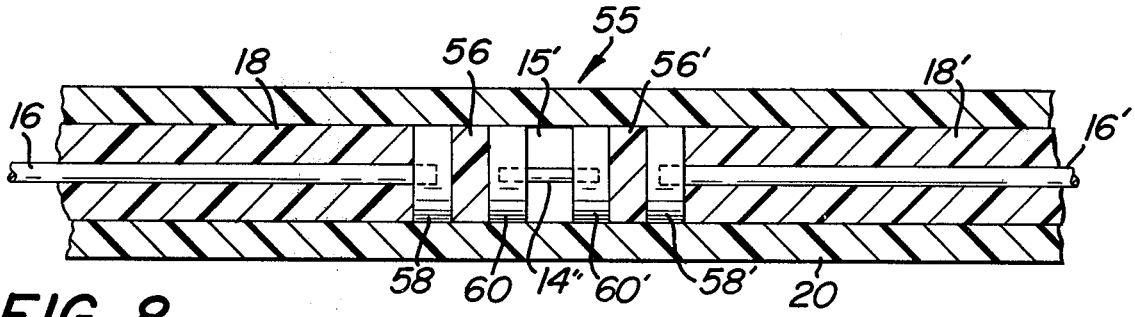
FIG. 8

COAXIAL CABLE AND METHOD OF MAKING THE SAME

BACKGROUND

A coaxial cable is a transmission line which has two conductors, each having the same axis, with one conductor surrounding the other conductor and being insulated therefrom by suitable dielectric material. Coaxial cable transmits or receives high or low power radio frequency signals up to and including millimeter wave frequencies. Such signals are used in a wide variety of fields including communications, medical equipment, temperature measurement, etc. Coaxial cable may be in three classifications, namely rigid, semirigid or flexible. A typical coaxial cable in simplified form is comprised of a center conductor surrounded by a dielectric layer which in turn is surrounded by an electrically conductive outer jacket. The center and outer conductors are generally high conductivity metallic materials.

It is known to connect coaxial cable with circuit components for providing frequency filters or time delays. A typical low-pass filter has one or more conductive discs concentric with a center conductor and surrounded by a dielectric sheet which is in turn surrounded by an electrically conductive outer jacket. Such circuit components are prefabricated as separate elements which are then mechanically and electrically coupled to adjacent ends of coaxial cables. The present invention includes recognition of various inherent disadvantages in using such prefabricated circuit components including problems in impedance matching at the joints between the circuit components and the coaxial cables, high manufacturing costs, inability to accurately tune the circuit components after assembly, limited power handling due to an air film between the dielectric material surrounding the circuit components and the ID of the outer jacket, the practical limit on the diameter of the cable when making small diameter coaxial cable, the lack of a radially continuous dielectric layer surrounding the circuit components, etc.

The present invention is directed to coaxial cable and the method of making the same so as to avoid the disadvantages set forth above while having other advantages as will be made clear hereinafter.

SUMMARY OF THE INVENTION

The present invention is directed to coaxial cable having at least one center conductor and a microwave circuit component electrically and coaxially coupled to said center conductor. A means is provided to define a seamless layer of dielectric material surrounding the circuit component and the center conductor. A single seamless outer jacket of electrically conductive material surrounds and compresses the solid dielectric material radially inwardly toward the circuit components. By seamless here it is meant that the jacket is cylindrically continuous and of a monolithic character without any intermediate threaded joints or the like. The ID of the outer jacket is in intimate contact with the dielectric material around the entire circumference. The outer jacket extends along the length of and is coaxial with the center conductor and the circuit component.

When practicing the method of the present invention in order to construct the coaxial cable, the center conductor and the circuit component are first enveloped by the seamless dielectric material and then inserted into the outer jacket. Thereafter, the unit is pulled through a die to reduce the ID of the outer jacket by standard cold drawing techniques.

It is an object of the present invention to provide a novel coaxial cable and practical method of manufacturing the same.

It is another object of the present invention to provide a coaxial cable and method of making the same wherein circuit components are incorporated inside the outer jacket without using mechanical adapters or connectors which interrupt the outer jacket.

It is another object of the present invention to provide a coaxial cable having a circuit wherein the outer jacket is a one piece seamless jacket of electrically conductive material extending along the length of the cable and circuit component.

It is another object of the present invention to provide a novel coaxial cable and a method of making the same which is simple, inexpensive to manufacture, lighter in weight, smaller in volume, uses fewer parts, has a higher voltage breakdown and consequently higher power handling ability, and has higher reliability. The circuit components are hermetically contained within the outer jacket to minimize contamination.

It is another object of the present invention to provide a coaxial cable which can be accurately tuned after the circuit components have been installed within the outer jacket.

Other objects will appear herinafter.

For the purpose of illustrating the invention, there is shown in the drawings a form which is presently preferred; it being understood, however, that this invention is not limited to the precise arrangements and instrumentalities shown.

FIGS. 1 and 1A are sectional views along a length of a coaxial cable at an intermediate step in manufacture.

FIG. 2 is a sectional view showing elements of the cable being drawn through a die to reduce the ID of the outer jacket to achieve the desired ID dimensions, and proper compression of the dielectric material.

FIG. 3 is a top plan view of coaxial cable made in aacordance with the present invention and showing one arrangement wherein the cable is bent.

FIG. 4 is an sectional view of a preassembly of an impedance transformer which may be used as one of the circuit components.

FIG. 5 is a sectional view through another embodiment of the cable of the present invention.

FIG. 6 is a transverse sectional view through a coaxial cable to illustrate an air articulated, fluted or ribbed cross-section of dielectric material around the center conductor.

FIG. 7 is a sectional view of a preassembly of a coaxial cable in accordance with the present invention wherein the circuit components are a band-reject filter.

FIG. 8 is a sectional view of a preassembly of a coaxial cable in accordance with the present invention wherein the circuit components are a band-pass filter.

Referring to the drawing in detail, wherein like numerals indicate like elements, there is shown in FIG. 1 a preassembly 10 of one or more microwave circuit components 12 such as conductive discs electrically and mechanically coupled to a center conductor 14 to form a low-pass frequency filter. The preassembly 10 is designed and fabricated in a conventional manner. The conductive discs are separated by any suitable dielectric material 15 including air. The circuit component 12 may be sized and positioned to form a conventional low-pass filter. One end of center conductor 14 is electrically coupled to one end of another center conductor 16 by soldering, brazing, etc. Conductor 16 is surrounded by a layer 18 of a dielectric material. If it is desired to have the preassembly 10 located between and spaced from the ends of the coaxial cable, the other end of center conductor 14 is similarly coupled to one end of a center conductor 16' which is surrounded by layer 18' of dielectric material.

A seamless tube 20 of a dielectric material is then telescoped over one of the layers 18, 18' beginning at the end thereof and is shifted to a position as shown in FIG. 1 so that it surrounds the preassembly 10. It will be noted that the tube 20 is of sufficient length so that its end portions overlap the juxtaposed ends of layers 18, 18'. The structure as shown in FIG. 1 is then telescoped into an oversized, seamless, outer jacket 22 of an electrically conductive material.

As shown in FIG. 2, the ID of jacket 22 exceeds the OD of tube 20 which in turn exceeds the OD of layers 18, 18'. One end of the preassembled unit is then swaged to a diameter small enough to pass through the die 24, and be grasped by jaw mechanism 25 for pulling and cold drawing through the die to achieve the desired final diametral dimensions. The swaged end is fed through the bore of the die 24 and is connected to the jaw mechanism 25 on a drawing bench. As jaw mechanism 25 is moved in the direction of arrow 27, the outer jacket 22 is drawn and its ID reduced to a dimension whereby it compresses the dielectric material 20 radially inwardly. In this manner, the ID of the jacket 22 can be in intimate contact with the entire circumference of the dielectric material. As the jacket 22 is being drawn, the tube 20 of dielectric material cold flows so as to become thinner in radial thickness. The dielectric material 20 is pressed into intimate contact with the conductive discs 12.

Thereafter, if desired, conventional RF connectors 30, 32 may be secured to the ends of the coaxial cable. If desired, intermediate portions of the coaxial may be bent at 26, 28 to any desired angle or configuration. As shown in FIG. 3, the location of the preassembly 10 within the jacket 22 is not visible since jacket 22 is a single one piece jacket extending for the full length of the cable. The only limitations on the length of the cable are the limits of the drawing equipment itself. Typically, the coaxial cable may have a length up to about 50 feet and the preassembly 10 may be located inside the jacket 22 at any point along the length of the jacket 22 or at one end thereof. In addition, the preassembly may even be located inside the jacket at either of the bends 26 and 28. Except for any end connectors 30, 32, the coaxial cable is uninterrupted so as to eliminate connectors and/or joints between its ends which create impedance losses, increased weight, increased costs, etc.

The dielectric materials 18, 18' and 20 should be capable of cold flow and should preferably have a dielectric constant which is uniform over a wide temperature range, have a dissipation factor as close to zero as possible, have a high dielectric strength, have a thermal expansion as close as possible to that of the center conductor and the outer jacket, and have low moisture absorption. The preferred dielectric material is polytetrafluoroethylene which is a self-lubricating polymeric plastic material sold commercially as TEFLON. Other equivalent dielectric materials having the above-identified attributes may also be utilized. For high temperature applications TEFLON foams, magnesium oxide or aluminum oxide may be utilized, although these do not necessarily possess the same lubricating and cold flow properties.

The outer jacket 22 may be any one of a wide variety of materials including copper, silver, silver coated copper, silver coated brass, aluminum, lead, etc. For high temperature, high pressure or corrosive environment applications, the outer jacket may be of beryllium copper, stainless steel or Inconel.

The center conductors 14, 16, 16' may be any one of a wide variety of solid or hollow materials including copper coated steel, silver coated steel, copper, etc. For medical applications, the center conductor may be tungsten, palladium, etc.

Referring to FIG. 4 there is shown a preassembly 34, namely an impedance transformer. The diameter of the center conductor 14' is stepped down in one or more steps in a conventional fashion. One end of the center conductor 14' is electrically coupled to one end of another center conductor 16 by soldering, brazing, etc. The other end of center conductor 14' is similarly connected to one end of a center conductor 16' which is surrounded by a layer 18' of dielectric material. The diameters of conductors 16 and 16' are different. Transformer preassembly 34 matches the impedances of the cables associated with center conductors 16 and 16' with minimum reflection as is well known in the art.

A seamless tube 20 of dielectric material is telescoped over dielectric layer 18' on center conductor 16 and is shifted to a position so that it surrounds the preassembly 34. The tube 20 is of sufficient length so that its end portions overlap the juxtaposed ends of dielectric layer 18' and conductor 16. The structure as shown in FIG. 4 is then telescoped into an oversized, seamless, outer jacket 22 and drawn through the die 24 as previously described. The dielectric material of tube 20 is compressed radially inwardly to intimately contact the entire circumference of the stepped center conductor 14.

As shown in FIG. 5, there is a variation of a coaxial cable produced according to the method described herein, involving a cable within a cable for transmitting and receiving a plurality of signals. In this variation, the jacket 22 is an intermediate conductor surrounded by a layer 36 of dielectric material comparable to that described above. The seamless layer 36 of dielectric material is surrounded by an outer seamless jacket 38 of conductive material compressing layer 36 radially inwardly and applied thereto in a manner as described above.

FIG. 6 is a cross sectional view of a ribbed or fluted air articulated dielectric material 44 of conventional manufacture. The dielectric material 44 is disposed within the dielectric tube 20 between conductive discs 12 as shown in FIG. 1. The dielectric material 44 strengthens the final assembly after the drawing operation. This structure is particularly desirable in applications wherein the circuit component is to be located in a bend 26 or 28 in the coaxial cable.

In FIG. 7, there is illustrated a cross section of a preassembly 46, namely a band-reject filter. Conducting bands 47 are axially spaced in conventional manner along the OD of the seamless layer of dielectric material 18. Each band 47 may enclose part or all of the circumference of dielectric 18.

A seamless tube 20 of dielectric material is telescoped over the preassemblyd 46 and is shifted to a position as shown in FIG. 7. The structure as shown in FIG. 7 is then telescoped into an oversized, seamless, outer jacket 22 and drawn through the die 24 as previously described. The dielectric material of tube 20 is compressed radially inwardly to intimately contact the entire circumference of the dielectric material 18 and bands 47.

In FIG. 8 there is shown a preassembly 55, namely a band-pass frequency filter. Circular discs 56 and 56' of dielectric material are sandwiched between and in series with central conductive elements 58, 60 and 58', 60' respectively. Any number of circular dielectric discs and conductive elements may be used in accordance with the desired filter characteristic.

The ends of center conductor 14'' are electrically coupled to conductive elements 60, 60' by soldering, brazing, etc. The conductive elements 60, 60' are separated by any suitable dielectric material 15' including air. Conductive element 58 is electrically coupled by soldering, brazing, etc., to a center conductor 16 surrounded by dielectric 18. Conductive element 58' is electrically coupled in similar fashion to center conductor 16' surrounded by dielectric 18'.

A seamless tube 20 of dielectric material is telescoped over one of the layers 18, 18' beginning at the end thereof and is shifted to a position as shown in FIG. 8 so that it surrounds the preassembly 55. The structure as shown in FIG. 8 is then telescoped into a seamless, oversized, jacket 22 and drawn through the die 24 as previously described. The outer jacket 22 is compressed radially inwardly to intimately contact the entire circumference of the dielectric material of tube 20. The dielectric material of tube 20 is pressed into intimate contact with the entire circumference of the dielectric discs and the conductive discs.

Coaxial cable can be made in accordance with the present invention so as to have almost any dimension fo the OD of the cable. On the low side, the OD of the cable may be as small as 0.008 inches. On the high side, the OD of the cable is a function of the cable efficiency and operating signal frequency and is limited only by available manufacturing equipment. A typical OD is 0.141 inches.

To tune a low-pass filter by the present invention, it is only necessary to pass the coaxial cable through a second smaller sinking die to further reduce the ID of the outer jacket 22. This further reduces the radial dimension between the outer periphery of the filter and the ID of the outer jacket 22 and has the effect of reducing the filter cutoff frequency. A change in impedance of the circuit component is almost directly proportional to the change in ID of the outer jacket 22.

The cable of the present invention is characterized by its monolithic character whereby there are no intermediate couplers or joints in the outer jacket for coupling the circuit component to the cable. The advantages of this feature are set forth above. Since the outer jacket is drawn through a die to the desired dimensions, the ID of the outer jacket is in intimate contact with juxtaposed surfaces of the dielectric material so as to preclude any air barriers therebetween where such air barriers are undesirable particularly at the area of the circuit components.

The present invention may be embodied in other specific forms without departing from the spirit or essential attributes thereof and, accordingly, reference should be made to the appended claims, rather than to the foregoing specification as indicating the scope of the invention.

I claim:

1. A coaxial cable comprising:

(a) at least one center conductor, (b) at least one circuit component electrically associated with said center conductor and coaxial therewith, (c) a tubular layer of dielectric material surrounding said circuit component and said center conductor respectively, and (d) a monolithic jacket of electrically conductive material surrounding said tubular layer and exerting radially inwardly directed compressive force on the entire circumference of said tubular layer of dielectric material, said jacket extending along the length of and being coaxial with said circuit component and said center conductor.

2. A cable in accordance with claim 1 wherein said circuit component is a frequency filter.

3. A cable in accordance with claim 2 wherein said filter is a low-pass filter.

4. A cable in accordance with claim 2 wherein said filter is a band-pass filter.

5. A cable in accordance with claim 2 wherein said filter is a band-reject filter.

6. A cable in accordance with claim 1 including a second layer of dielectric material which surrounds said center conductor, said tubular layer of dielectric material surrounding said second layer and being a polymeric plastic which will cold flow.

7. A coaxial cable comprising a stepped center conductor, a tubular layer of dielectric material surrounding said stepped center conductor, and a monolithic jacket of electrically conductive material surrounding and compressing the outer circumference of said layer of dielectric material radially inwardly to eliminate any air space there between along the length thereof, said jacket extending along the length of and being coaxial with said stepped center conductor.

8. A method of making a coaxial cable comprising:

(a) electrically coupling at least one circuit component to a first center conductor so as to be coaxial therewith, (b) electrically coupling said circuit component to a second center conductor surrounded by a dielectric material coaxial therewith, (c) surrounding said circuit component and said dielectric material surrounding said second center conductor with tubular dielectric material, (d) inserting the thusly formed structure into an oversized jacket of electrically conductive material, (e) and then reducing the ID of said jacket to a predetermined ID while said circuit component is inside said jacket to cause said jacket to apply a radially inwardly directed compressive force on said tubular dielectric material and to cause said jacket ID to be spaced radially from the OD of the circuit component by a predetermined distance.

9. A method in accordance with claim 8 wherein the dielectric marterial around the circuit component is attained by telescoping said tubular dielectric material over the circuit component in a manner so that an end portion of the tube overlaps an adjacent end portion of the dielectric material surrounding the second center conductor.

10. A method in accordance with claim 8 including positioning the circuit component so as to be located between the ends of said jacket before said reducing step so that the location of said component within said jacket is not visible to the naked eye.

11. A method in accordance with claim 8 including tuning the frequency of said component while it is in said jacket by passing the jacket through a reducing die and reducing the jacket ID to reduce the thickness of the tubular dielectric material.

12. A method of making a coaxial cable comprising:

(a) surrounding a circuit component and a center conductor with a coaxial seamless tubular layer of dielectric material which will cold flow, (b) inserting said structure of step (a) into an electrically conductive jacket, and (c) apply compressive force radially inwardly on the entire circumference of said material by reducing the inner diameter of said jacket while said circuit component and said material are inside said jacket to thereby avoid an air film between said jacket and that portion of said dielectric material surrounding said component.

13. A method of making a coaxial cable comprising:

(a) surrounding a stepped center conductor with a coaxial tubular layer of seamless dielectric material spaced radially outwardly therefrom and out of contact with said conductor, (b) inserting said structure of step (a) into an electrically conductive jacket, and (c) reducing the inner diameter of said jacket and the wall thickness of said material along the length thereof while said structure and material are inside said jacket.

14. A coaxial cable comprising a center conductor having a stepped impedance transformer coaxial therewith, a tubular layer of dielectric material surrounding said conductor and transformer, a monolithic jacket of electrically conductive material surrounding and compressing the outer circumference of said layer of dielectric material radially inwardly toward said conductor to minimize air space between said jacket dielectric material as well as air space between said dielectric material and said center conductor, and said jacket extending along the length of and being coaxial with said conductor.

* * * * *